US008302965B2

(12) United States Patent
Grant

(10) Patent No.: US 8,302,965 B2
(45) Date of Patent: Nov. 6, 2012

(54) TABLE TOP BALL GAME

(75) Inventor: Gary Scott Grant, Mooroolbark (AU)

(73) Assignee: Stadium Table Games Pty Ltd (AU)

( * ) Notice: Subject to any disclaimer, the term of this patent is extended or adjusted under 35 U.S.C. 154(b) by 107 days.

(21) Appl. No.: 12/529,186

(22) PCT Filed: Mar. 3, 2008

(86) PCT No.: PCT/AU2008/000277

§ 371 (c)(1),
(2), (4) Date: Dec. 12, 2009

(87) PCT Pub. No.: WO2008/104033

PCT Pub. Date: Sep. 4, 2008

(65) Prior Publication Data

US 2010/0102506 A1 Apr. 29, 2010

(30) Foreign Application Priority Data

Mar. 1, 2007 (AU) ..... 2007100164

(51) Int. Cl.
*A63F 7/06* (2006.01)

(52) U.S. Cl. ..... 273/108.1; 273/108.52; 273/108.56

(58) Field of Classification Search ..... 273/108–108.57, 273/109–129 W
See application file for complete search history.

(56) References Cited

U.S. PATENT DOCUMENTS

| | | | | | |
|---|---|---|---|---|---|
| 409,251 | A | * | 8/1889 | Snell | 273/113 |
| 600,738 | A | * | 3/1898 | McClure et al. | 273/108.5 |
| 713,253 | A | * | 11/1902 | Taylor | 273/108.2 |
| 944,452 | A | * | 12/1909 | Mack | 273/317.8 |
| 1,053,788 | A | * | 2/1913 | Crew | 273/317.7 |
| 1,627,087 | A | * | 5/1927 | Grant | 273/108.31 |
| 1,703,240 | A | * | 2/1929 | Jacobson | 273/108.4 |
| 1,934,381 | A | * | 11/1933 | Slosson | 273/108.52 |
| 2,237,486 | A | * | 4/1941 | Henderson | 273/108.53 |
| 3,782,726 | A | * | 1/1974 | Huffman et al. | 273/108.41 |
| 3,815,911 | A | * | 6/1974 | Cooper | 463/69 |
| 4,002,338 | A | * | 1/1977 | Gamber | 273/122 A |
| 4,260,152 | A | * | 4/1981 | Karlsen | 273/317.3 |
| 4,294,448 | A | * | 10/1981 | Oler | 273/108.41 |
| 4,480,833 | A | * | 11/1984 | Barcelow et al. | 273/108.56 |
| 5,222,735 | A | * | 6/1993 | Savage | 273/108.53 |
| 5,492,325 | A | * | 2/1996 | Hawver | 273/115 |
| 6,217,025 | B1 | * | 4/2001 | Yamazaki et al. | 273/340 |

(Continued)

FOREIGN PATENT DOCUMENTS

GB 190305879 0/1904

(Continued)

*Primary Examiner* — Sebastiano Passaniti

(74) *Attorney, Agent, or Firm* — John F. Letchford; Archer & Greiner, P.C.

(57) ABSTRACT

A table top ball game that enables two or more people to play a variety of ball sports. Games are based on foosball/soccer table games and use similar controls, skills and operations to those already in existence. The stadium games enhance the game experience by adding features that are present in real games and by resembling the shape and imitating the images, sounds and atmosphere of a real stadium. Another aspect of the present invention provides a protective volume around the distal ends of the user operated control rods with a plurality of player figure mounted thereon. A further aspect of the present invention provides a plurality of means for eliminating dead spots on a playing surface while providing an improvement of the game.

15 Claims, 9 Drawing Sheets

U.S. PATENT DOCUMENTS

| | | | | |
|---|---|---|---|---|
| 6,663,108 | B2 * | 12/2003 | Makhoul | 273/317.3 |
| 6,773,010 | B2 | 8/2004 | Zucchi et al. | |
| 6,805,348 | B1 * | 10/2004 | Chen | 273/108.32 |
| 6,991,231 | B1 * | 1/2006 | Tien | 273/108.1 |
| 2001/0033052 | A1 | 10/2001 | Rossi et al. | |

FOREIGN PATENT DOCUMENTS

| | | |
|---|---|---|
| GB | 507500 | 6/1936 |
| GB | 864998 | 4/1961 |
| GB | 2423726 | 9/2006 |

* cited by examiner

Figure 1 - Stadium Table Games

Perspective view of irregular active playing field surface

TABLE TOP BALL GAME

BACKGROUND OF THE INVENTION

The present invention relates to a table top ball game but is not limited to such. It is particularly related to soccer (football) game type tables having user operated rods that control player figures located at positions above the playing surface. The present invention encompasses soccer games as well as other kicking ball and carrying ball type games such as Australian Rules football and Gaelic Football.

Soccer table top ball game apparatuses have been known for many years. These games generally comprise a substantially horizontal flat playing surface which is enclosed within a rectangular open top "box". The playing surface is typically rectangular with four sidewalls that define right-angled corners. Goal openings are provided at the centre of each end wall extending along the short sides of the rectangular playing surface.

There are a number of parallel mounted user operated rods that are used to control the player figures that populate the game's playing surface. Typically each user operated rod extends through bores provided in each of the game long sidewalls of the open top box. These user operated rods are located at equidistant height above the playing surface and in a substantially perpendicular orientation to the long sidewalls.

Typically there are a total of eight user operated rods, four rods for each soccer team although other configurations are possible. Generally the rods have a handle at one end. Each team has alternating rods with their handles extending out a common sidewall such that one or more players for one team can stand on one side of table top ball game and control their teams players while the one or more players of the opposing team control their rods by handles extending from the opposing sidewall and the one or more players of the opposing team can stand on the opposing side of the table top ball game. The rod closest to each goal represents the respective goalie. One or more player figures are mounted on each user operated rod such that the player figures are suspended above the playing surface.

Each user operated rod is mounted with the handle and limiting means used by a game user to both rotate the rod and the player figures mounted thereon, as well as shift the lateral position of the player figures within a limited range relative to the playing surface.

The soccer game may be played by each game user controlling the player figures on the user's team to advance a game ball past the opponent's player figures and into the opponent's goal.

Due to inherent limitations on the length and reach of the user operated rods, it may not be possible for the player figures to reach a ball located in one of the corners or on the boundary. Thus, the corners and the boundary may constitute a "dead spot" on the playing surface.

Accordingly, there is a need for a soccer table top ball game apparatus that eliminates dead spots at the boundary of the playing surface, and/or reduces the tendency of the game ball from resting in these dead spots.

Dead spots can also be found within the boundaries of the playing surface, where the ball may come to rest at a position that is in a parallel line with the user operated rods and is between the rows of player figures. In this case neither player is able to reach the ball with their player figures.

Accordingly, there is a need for a soccer table top ball game apparatus that eliminates dead spots within the playing surface, and/or reduces the tendency of the game ball from resting in these dead spots.

Many current versions of these ball table games are constructed such that the player operated rod extends completely through the opposite side of the outer enclosure. This provides a simple means of construction but has the disadvantage of obstructing the player on the opposite side of the table game. The protrusion of a user operated rod can also cause injury to a player on the opposite side of the table top ball game apparatus by poking into such player or by that player running into a protruding rod. Furthermore players on the opposite side of the table game can frustrate a player by deliberate obstruction of the player's user operated rod.

There is a need for a simple means of preventing the user operated rod from protruding the game enclosure on the opposite side of the game enclosure. There is also a need for a table top ball game with a game playing surface that more closely resembles the playing area of the actual game being played

SUMMARY OF THE INVENTION

It is therefore an object of the present invention to provide a table top ball game that more closely resembles a real ball game stadium.

It is another object of the present invention to eliminates dead spots on the playing surface and perimeter of the table top ball game apparatus.

It is yet another object of the present invention to provide a table top ball game with playing surface ball capture and manual or automatic reinsertion of the ball into the playing surface.

It is still yet another object of the present invention to provide a soccer table top ball game apparatus that has crowd sounds and other sounds associated with the game being played including but not restricted to, siren sounds, emergency vehicle sounds, half time entertainment sounds and the like.

It is yet another object of the present invention to provide a more realistic looking game shape. The table game and associated game playing field can be made to more closely resemble a real game stadium.

It is yet another object of the present invention to provide manual and automatic game scoring.

It is yet another object of the present invention to prevent the user operated rods from protruding to the opposite side of the table top ball game apparatus.

Additional objects and advantages of the invention are set forth, in part, in the description which follows and, in part, will be apparent to one of ordinary skill in the art from the description and/or from the practice of the invention.

In accordance with the invention there is provided a table top ball game apparatus for providing a simulation of a field game play of a ball game between two teams, the apparatus including: a substantially horizontal playing surface; with a substantially vertical boundary surface surrounding the playing surface; a number of parallel user operated rods are mounted to extend through bores provided in each of the vertical boundary surfaces forming game apparatus sidewalls wherein the user operated rods are used to control a plurality of player figures mounted thereon that populate above the game's playing surface and provide striking elements of a ball on the substantially horizontal playing surface; whereby the game apparatus includes one or more means for eliminating dead spots where the plurality of player figures cannot strike the ball on the playing surface.

The table top ball game forms a stadium effect which has an improved means of operation wherein said boundary surface includes upper side surrounds formed by outwardly sloping sidewalls extending from an upper side of the substantially vertical boundary surface whereby to assist the game ball being maintained within the playing surface while allowing ready viewing of the playing surface and while providing a stadium appearance and a transparent upper dome section connected to the upper side surrounds to provide an enclosed means for maintaining the ball within a confined volume while said one or more means for eliminating dead spots ensures continual means of play.

The present invention takes into account the added realism that is desired for ball games other than soccer. The shape of the table can be made to more closely resemble an actual ball game stadium. The table shape can be made other than a rectangle thereby making the table look like a miniature stadium complete with external decoration and embellishments that would be found on a typical ball game stadium.

Further the present invention incorporates a domed cover that is positioned over the playing surface so that it does not obstruct the game. The dome preferably has a domed shape that will discourage the placement of drinks and other items that the players may thoughtlessly place on the game enclosure. Furthermore the domed shape adds to the aesthetics of the game. The dome will preferably be made of a resilient clear material so that the view of the game is not obstructed but will have enough resistive quality so that the players or observers cannot interfere with the motion of the ball in play.

The table top ball game has a substantially horizontal playing surface has at least one singular or multiple scoring openings at the two longitudinal ends of the playing surface for receiving the game ball and with automatic detection means mounted in or adjacent the scoring openings and a scoreboard providing a stadium type presentation of the detected score.

The one or more means for eliminating dead spots can also provide an additional play element to the game play during a game. The present invention eliminates the problem of ball dead spots around the boundary of the playing area and the substantially vertical boundary surface by the inclusion of one or more ball deflectors located along the substantially vertical boundary surface. The purpose of the ball deflectors is to deflect the ball in play away from the boundary surface and always back into the active game area. Furthermore to eliminate playing surface dead spots, the inventor has created a slight depression or undulation in the playing surface so that the ball in play cannot come to rest on the actual playing surface. The ball will tend to run to lowest point on the playing surface. This low point has an opening which will accept the ball and within this pathway is a ball ejection mechanism that will return the ball into active play.

The one or more means for eliminating dead spots can include said substantially vertical boundary surface surrounding the playing surface having at least one ball deflection device that will urge the ball to remain within the playing surface.

Also the one or more means for eliminating dead spots can include a plurality of undulations of said playing surface for providing ball deflection that will urge the ball to remain within the range of the plurality of player figures mounted on the parallel user operated rods above the playing surface. The undulations can extend across the entire width of the playing surface and extend between adjacent parallel user operated rods. The height of the undulations above the playing surface can be about half the ball height. The undulation height can be in the range of 2 to 10 mm The shape of the undulations can be a peaked undulation extending above a substantially flat playing surface. The undulation can be symmetrical such that the effect of a ball hitting the undulation from either side is the same. Alternatively the undulation can be asymmetrical such that the effect of a ball hitting the undulation from either side is different and therefore the game play can be adjusted by the undulation near a particular goal can provide a different effect to a ball struck by the defending team and striking one side of the undulation to the effect of a ball struck by the attacking team and striking the other side of the undulation.

The difference of effect can be to provide different heights of ball flight clue to the differing shape of respective sides of the undulation. In particular the undulations can have a height and shape to provide a launch of the game ball above the parallel user operated rods.

Further the nature of the game can be altered in construction by altering the spacing of the parallel user rods and the undulations. The primary requirement is thatr the base of the undulation to the adjacent parallel user operated rod can be less than the extension of the player figures from the user operated rod on which they are attached and the diameter of the game ball. The differing spacing allows you to make a section of the playing field sparser so as to simulate the real field game strategies more effectively. The spacing of the base of the undulation to the adjacent parallel user operated rod is substantially the distance of the extension of the player figures from the user operated rod on which they are attached and the radius of the game ball.

The table top ball game apparatus can includes vertical side supports and outwardly sloping sidewalls extending from an upper side of the substantially vertical boundary surface and an outer skin surface extending from an underneath or outer part of the outwardly sloping upper sidewalls to extend substantially parallel to the substantially vertical side supports whereby providing spaced support of the handle end of the user operated rods when mounted in bores of both the outer skin surface and the vertical side supports and whereby the distal end of the user operated rods is located in a protected volume that cannot be accessed by an opposing player on the opposing side of the first players user operated rods. The rods can be encased in a cylinder or in spaced sheaths or merely in spaced bores substantially within the protected volume such as to add strength and prevent bending of the rods.

The present invention takes into account the problems associated with user operated rods that protrude the opposite side of the game enclosure. In the preferred embodiment of this invention no user operated rods protrude on the opposite side of the game enclosure. This is achieved without the need for telescopic rods, which is a common way of alleviating the problems associated with protruding rods.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention In this respect, before explaining at least one embodiment of the invention in detail, it is to be understood that the invention is not limited in this application to the details of construction and to the arrangement so the components set Forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore that the claims be regarded as including such equivalent constructions insofar as they do not depart from the spirit and scope of the present invention.

The abstract is neither intended to define the invention of the application, which is measured by the claims, nor is it intended to be limiting as to the scope of the invention in any way,

BRIEF DESCRIPTION OF THE DRAWINGS

These together with other objects of the invention, along with the various features of novelty which characterize the invention, are defined with particularity in the claims annexed to and forming a part of this disclosure, For a better understanding of the invention, its operating advantages and the specific objects attained by its uses, reference would be had to the accompanying drawings, depictions and descriptive matter in which there is illustrated preferred embodiments and results of the invention wherein:

DETAILED DESCRIPTION OF THE PREFERRED EMBODIMENTS

Figure 1:
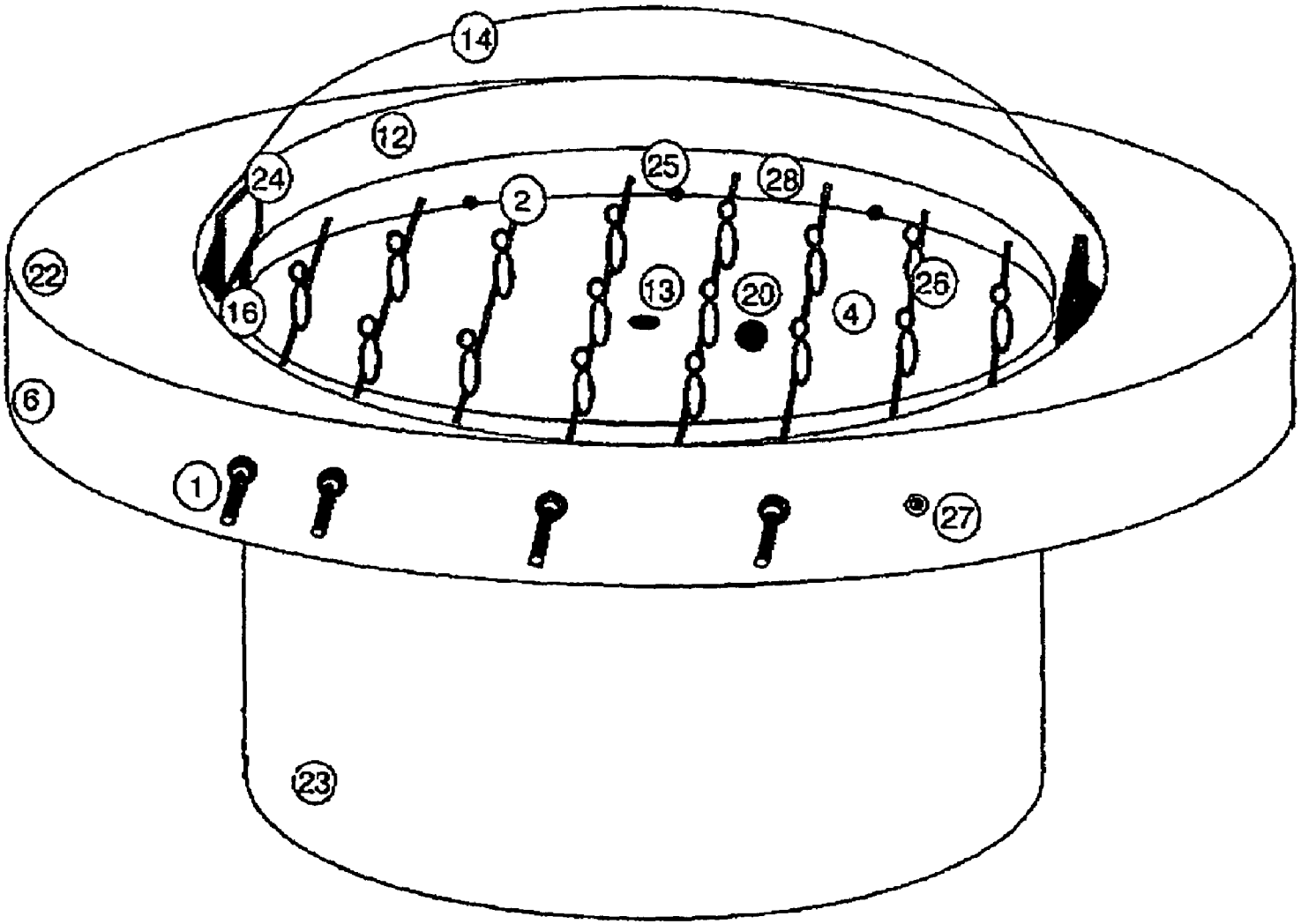
FIG. 1 is a perspective view of a preferred embodiment of a table top ball game apparatus in accordance with an embodiment of the invention

Referring to the drawings in detail, like reference characters refer to like elements in the other drawing figures.

With reference to FIG. 1 in particular, the table top ball game apparatus of one embodiment of the invention has an enclosed playing volume having a playing surface 4 beneath a dome 14 that is mounted on a table bench design supported by a support means 23 so as to be at playable height when users are standing. In this form the table bench design is substantially oval and supported on an oval or circular leg formation 23.

The table top ball game apparatus simulates a field game play of a ball game such as football, soccer, basketball or other similar ball game between two teams. The apparatus has a substantially, horizontal playing surface 4 with goal openings 16 at opposing ends and a substantially vertical boundary surface 28 surrounding the playing surface. A number of parallel user operated rods 2 are mounted to extend through bores provided in each of the vertical boundary surfaces 28 forming game apparatus sidewalls wherein the user operated rods are used to control a plurality of player FIG. 26 mounted thereon that populate above the game's playing surface and provide striking elements of a ball on the substantially horizontal playing surface.

In this preferred embodiment, there is a general oval shape of the playing surface 4 with perimetrical vertically extending side walls that define the game shape. Opposed goal openings 16 are provided at the ends of the playing surface 4. User operated rods 2 extend across and above the playing surface 4. Mounted on these user operated rods 2 are the player FIG. 26.

It can be understood that player FIG. 26 located at points along user operated rod 2 will rotate and move laterally as the user operated rod 2 is rotated and moved laterally.

Figure 2:
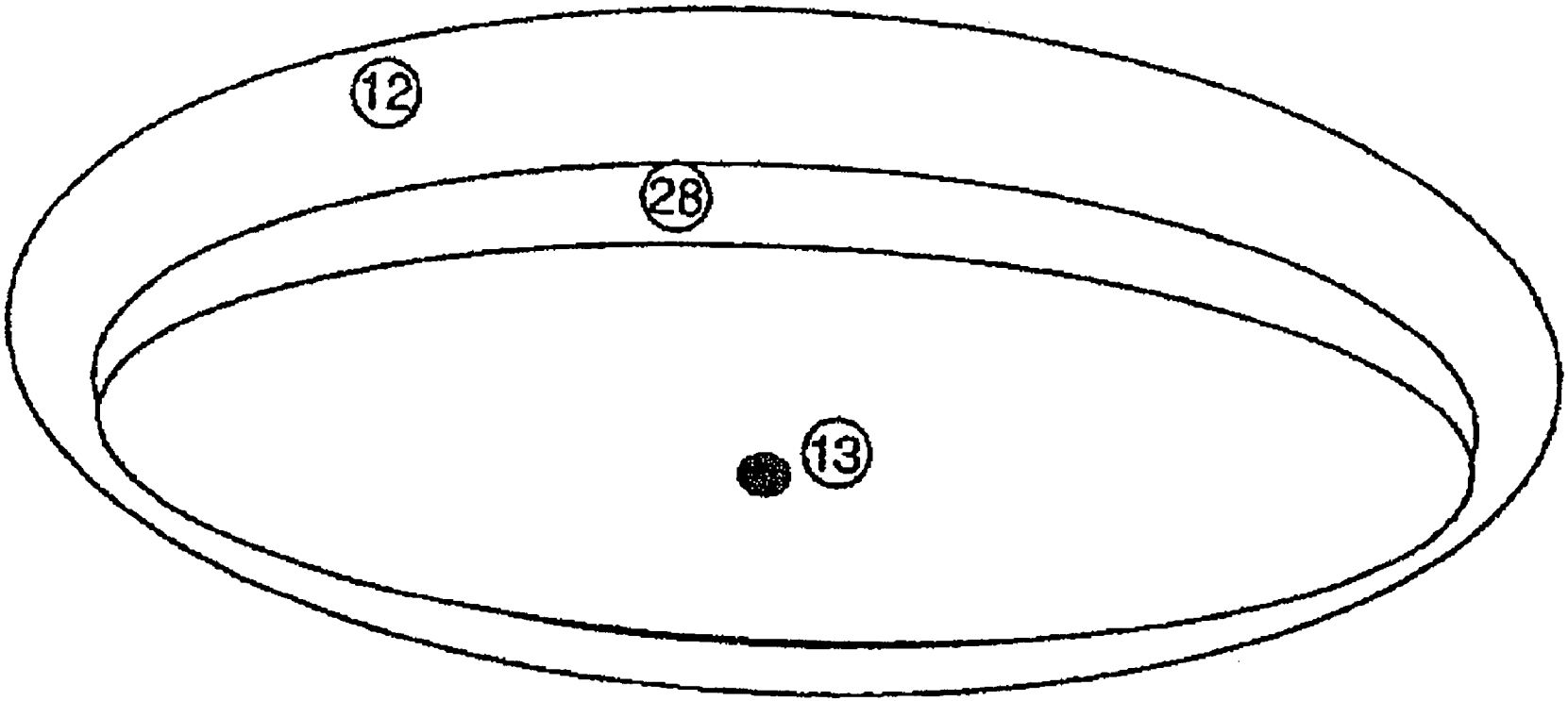
FIG. 2 is a view of the boundary deflector means forming a stadium effect of the table top ball game apparatus of FIG. 1.
Figure 3:
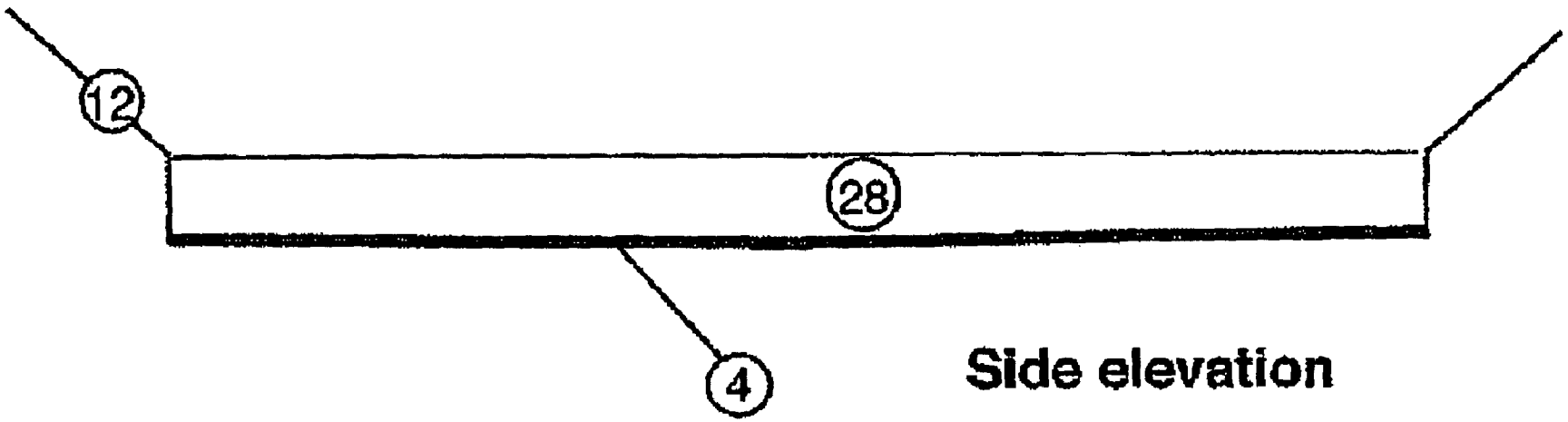
FIG. 3 is a side elevation of the boundary deflector means forming a stadium effect of FIG. 2.

With reference to FIGS. 2 and 3 in particular, there is a substantially vertical boundary surface 28 surrounding and in close proximity to the playing surface 4. This boundary forms an integral part of the game construction, in that it forms part of the player rod 2 support and defines the playing surface 4. It also adds substantially to the realism of the entire game. Attached to the top edge of the boundary surface 28 is an outwardly sloping surface 12. This sloping surface visually interfaces the shape of the playing surface 4 to the shape of the table top ball game apparatus to provide a stadium effect while also aiding in retaining the ball within the playing volume. Covering the playing surface and the sloping surface 12 is a transparent dome cover 14. This keeps the game surfaces clean and protected and provides an enclosed playing volume. However such volume is not effective unless the dead spots are eliminated.

Also shown in the FIG. 3 there is a side elevation of the sloping surface 12. The purpose of sloping surface 12 is to provide a mechanical and aesthetic link between the playing surface 4, the boundary surface 28 and the outer surface of the table top ball game apparatus. It can be understood that the sloping surface 12 completely surrounds the boundary surface 28 and is demonstrated in FIGS. 1, 2 and 3. Crowd scenes and other features can be added onto this sloping surface 12 to further create a more realistic stadium atmosphere.

Figure 4:
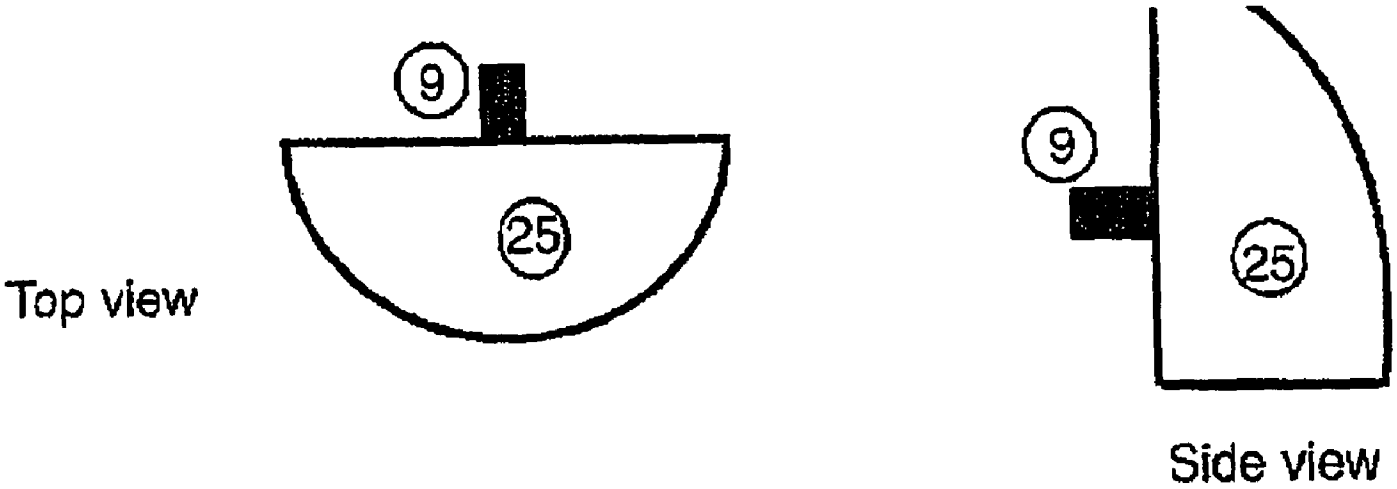
FIG. 4 is an embodiment of a non-spherically shaped ball.

With reference to FIG. 4 there is shown an embodiment of a means to create the illusion of a non spherical ball 20. It is desirable to recreate the non spherical ball used by some codes of football. A means of providing the illusion of a non spherical ball is described. Enclose within a transparent material that is of suitable qualities for the game to be played, is a shape that is non spherical. This may be an oblong shape as used in Australian Rules football.

Figure 5:
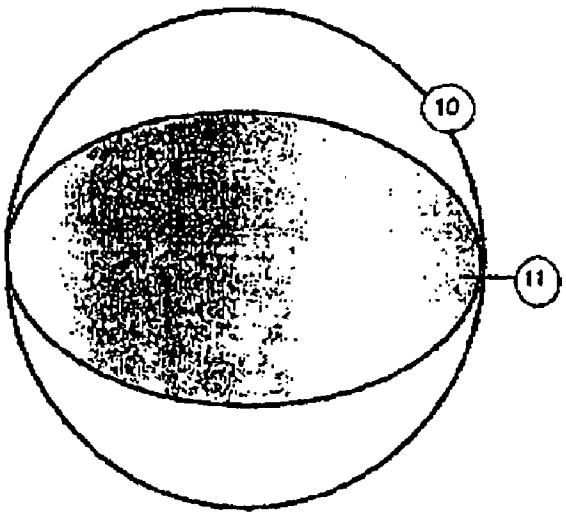
FIG. 5 is a top view and side view of a ball deflector that can be positioned in dead spots such as corners.

The game apparatus includes one or more means for eliminating dead spots where the plurality of player figures cannot strike the ball on the playing surface. With reference to FIG. 5 in one embodiment there is a ball deflector 9. One or more of these deflectors are placed around the boundary surface 28. The ball 20 may under some circumstances be captured by centrifugal forces that cause the ball to hug the boundary surface 28, which will effectively keep the ball out of play. Ball deflectors 9 are generally positioned around the perimeter of the playing surface 4, urge any ball travelling around the perimeter to deflect back onto the main portions of the playing surface 4.

Figure 11:
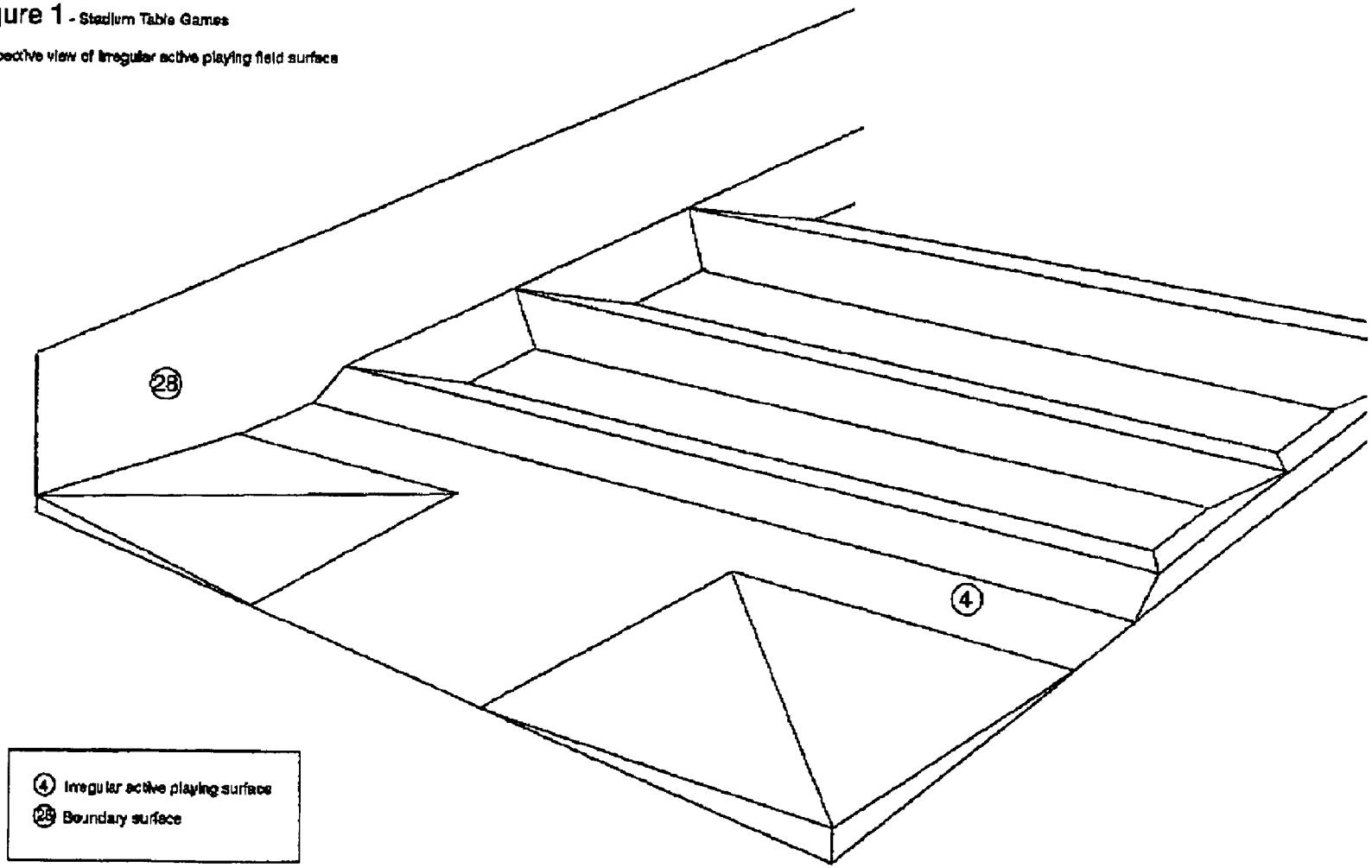
FIG. 11 is an embodiment of the undulation system for removing dead spots on the playing surface of the table top ball game apparatus of FIG. 1.

Another form of means for eliminating dead spots is shown in FIG. 11 where there are undulations of the playing surface. In one form these are created by placing shapes on top of a flat playing surface to form an undulating or corrugated playing surface such the ball is urged to positions at which the player figures can strike the ball on the playing surface. These undulations can extend along the side walls, across the playing surface or in the corners of the player surface. This will be further described later.

Figure 7:
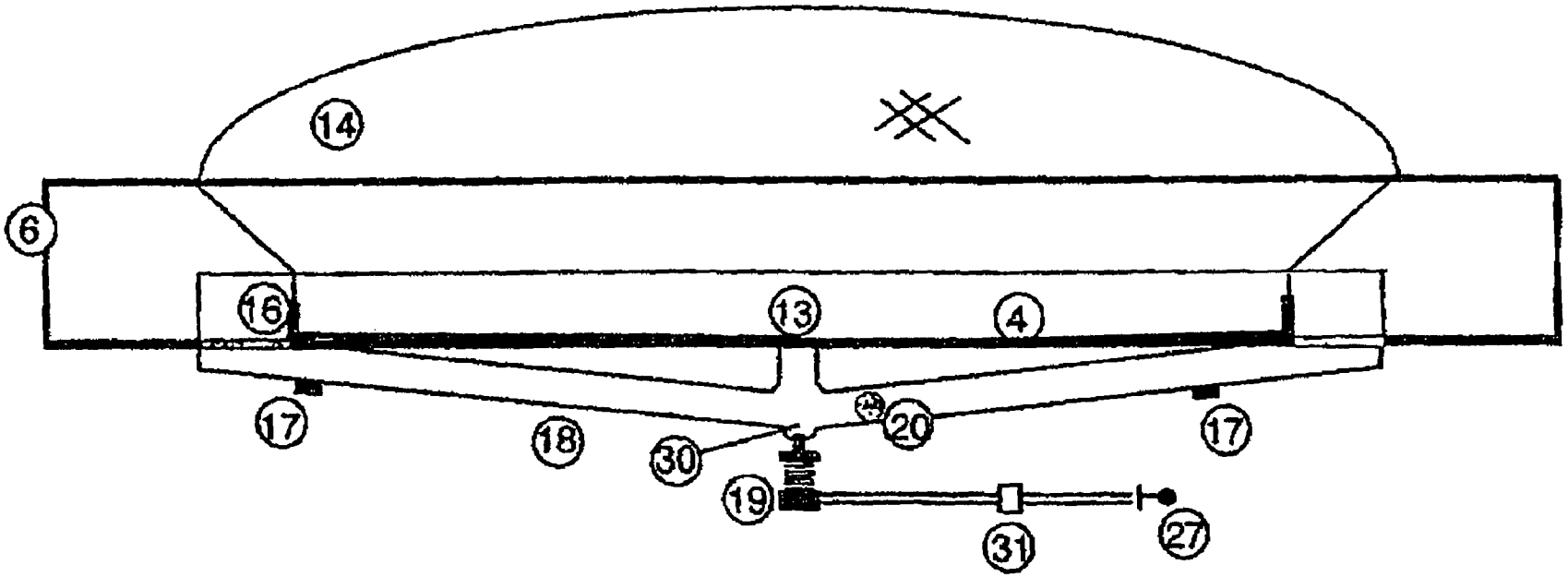
FIG. 7 is an side cross section of the playing surface, the surrounding boundary surface and sloping surrounds forming a stadium effect and the ball return and ball ejection mechanism of the table top ball game apparatus of FIG. 1.

With reference to FIG. 7 there is substantially located in the centre of the playing surface 4 is a ball opening 13. This opening can both capture the ball 20 and eject the ball 20 back onto the playing surface 4. A user operated button 27 can be used to cause the ball ejector to operate and insert the ball into play. Associated with the ball ejector is the goal ball return. When a ball is "played" through opening 16, the ball will be returned to the ball ejector position and manually or automatically reinserted back onto the playing surface 4. A ball captured in this ball opening 13 will be manually or automatically reinserted onto the playing surface 4 by ball reinsertion mechanism 19.

This in one embodiment of a means to return a ball that has scored, back onto the playing surface, when ball 20 enters a goal opening 16 the ball 20 is able by momentum and gravity to carry along channel 18 to settle in a position 30, which is located substantially directly above solenoid 19. User operated button 27 can be used to complete a circuit 31 which will momentarily operate solenoid 19 which will then reinsert the ball 20 back onto the playing surface 4. Dome 14 prevents users from interfering with the playing surface 4 or ball 20. Automatic scoring of user goals can be implemented by incorporating ball sensors 17 along the ball return channels 8. When a ball 20 enters the goal opening 16 the sensor 17 can detect the ball 20 and increment the score for the associated goal.

Figure 6:
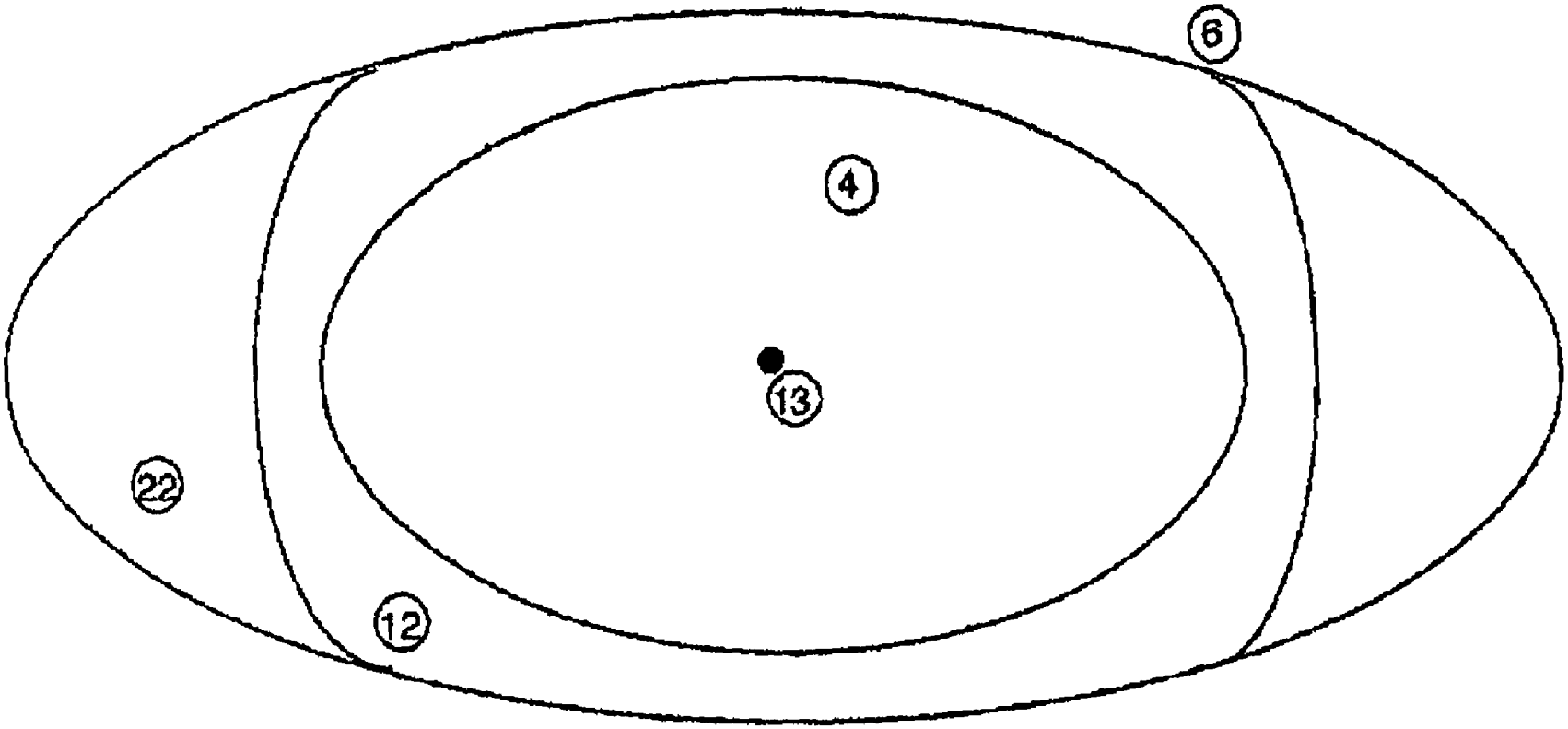
FIG. 6 is an overhead view of a preferred embodiment of the playing surface, the surrounding boundary surface and sloping surrounds forming a stadium effect and providing a table end surfaces.

Referring to FIG. 6 there is shown an overhead view that shows the playing surface 4 with the return ball opening 13 and surrounded by the boundary surface 28 and the sloping surface 12.

Figure 8:
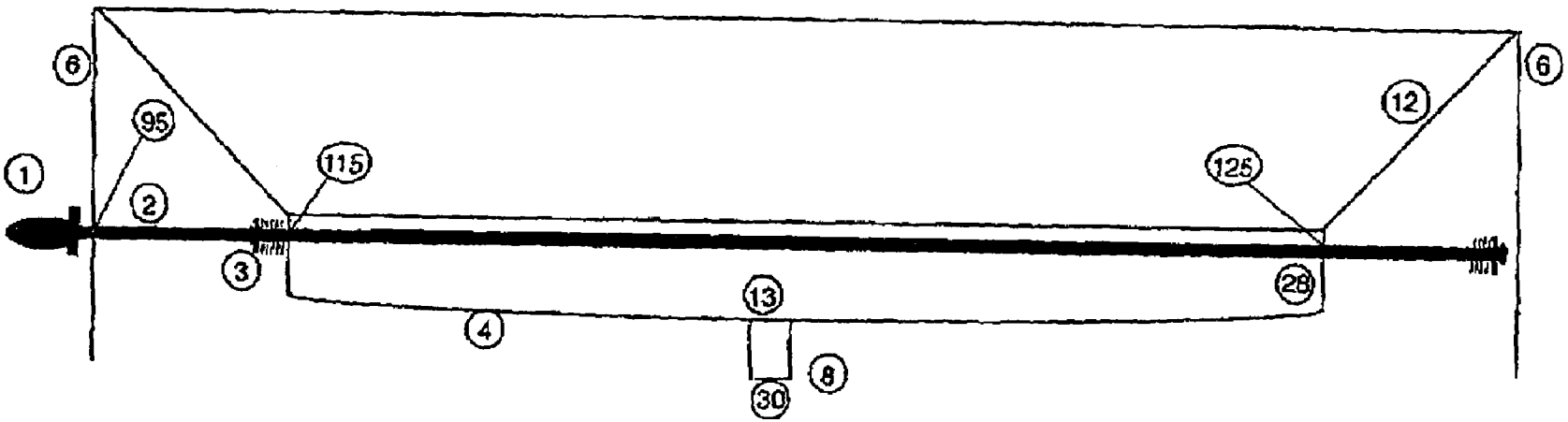
FIGS. 8 and 9 are lateral cross sections of two preferred embodiments of the non protruding player control rod system.
Figure 9:
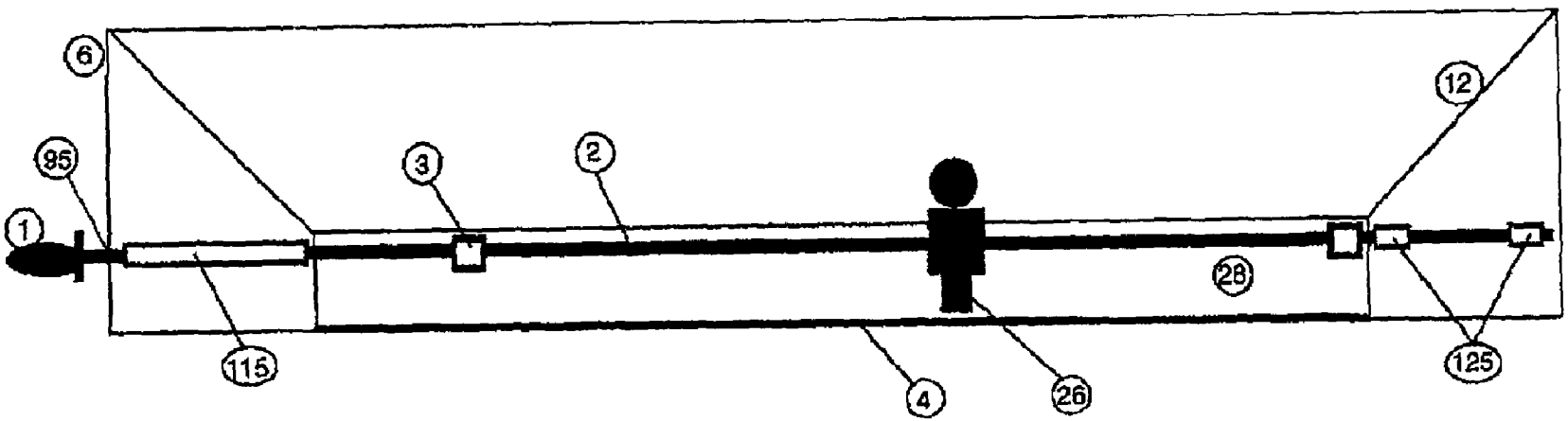
Figure 10:
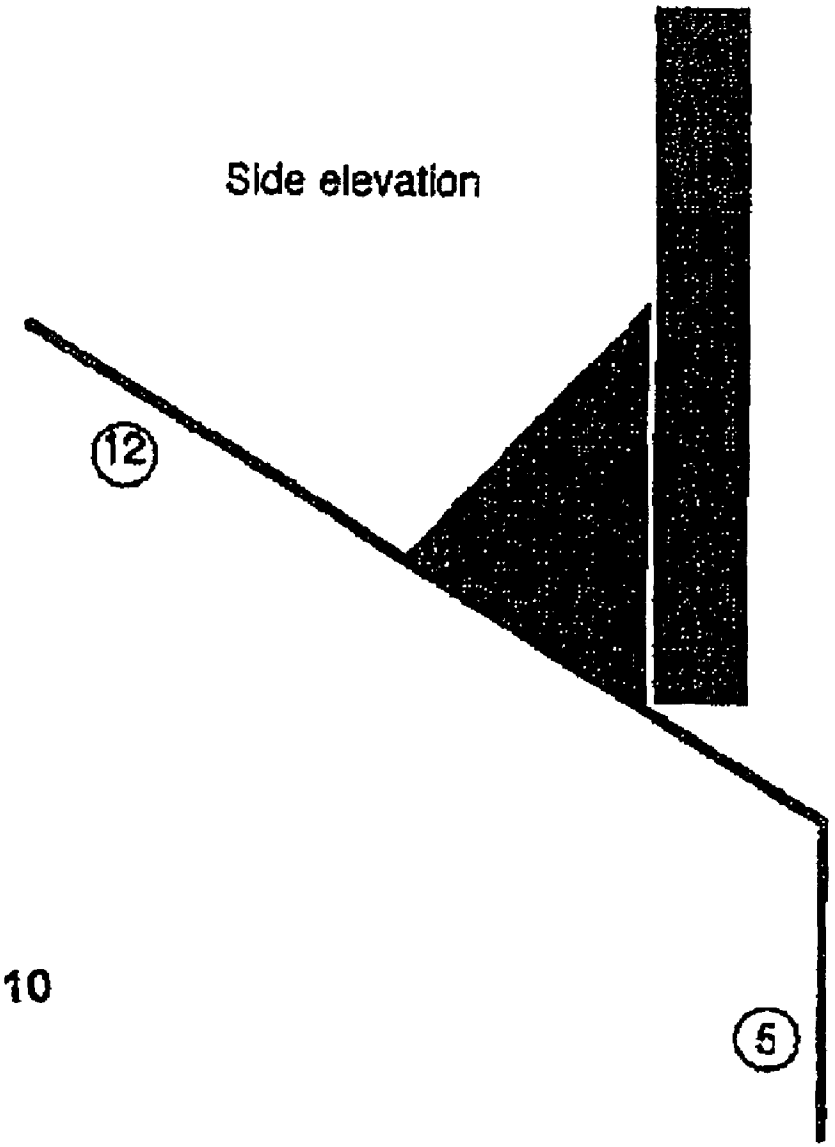
FIG. 10 is a side elevation of a scoreboard system in stadium display mode on the table top ball game apparatus of FIG. 1.

With reference to FIGS. 8 and 9 there is shown user operated rods 2 extend across the playing surface 4 between and generally at right angle to the longer sidewalls of the table top ball game apparatus. Each user operated rod 2 extends through a bore 95 located on the outer skin 6. Each user operated rod 2 also extends through a corresponding bore 115 and 125 between and generally perpendicular to the boundary surface 28. The distance between the boundary surface 28 and the outer sidewalls 6 is such that when user operated rods 2 are at Rill displacement in an inward direction, the user operated rod 2 will not be of sufficient length to contact the opposite sidewall 6. When the user operated rod 2 is fully displaced in an outwards direction, there is enough length of user operated rod 2 such that the end of the user operated rod 2 will not be able to exit the bore 125. In this manner the user operated rod has sufficient length and displacement to allow player FIG. 26 to cover a sufficient area of playing surface 4 without user operated rod 2 having to protrude the outer sidewall 6. User operated rods 2 generally have a handle 1, for comfort and better control. Attached to the user control rods 2 is a shock absorption means 3, shown as a captured spring, that will prevent any harsh jarring as the user operated rods 2 come to the maximum stop positions. It can be understood that as the user operated rod 2 approached either of its displacement limits, the shock absorption means 3 will begin to interact with boundary wall 28, thereby cushioning the user operated rod at the extreme displacement positions.

Typically there are a total of eight user operated rods 2, four rods for each ball team. One or more player FIG. 26 are mounted on each user operated rod 2 such that the player FIG. 26 are suspended above the playing surface 4. Typically, the player FIG. 26 closest hi proximity to the respective goal openings 16 are generally referred to as goal keepers or in the case of Australian Rules football, full backs. The user operated rods 2 each include a handle 1 used by a genie user to both rotate the rod axially and the respective player FIG. 26 mounted thereon, as well as shift the lateral position of the player FIG. 26 relative to the playing surface 4.

The depression formed into the playing surface 4, urges the ball towards the ball opening 13, located substantially in the centre of the playing surface 4.

However the use of undulations such as peaks arranged on a flat surface to form an undulating playing surface 4 provides a substantial improvement in operation of the game. Apart from forming a means for eliminating dead spots, it also forms a means for aiding simulation of the game to the field game by providing mechanisms for changing the nature of the game. This includes the spacing of the undulations or peaks to change the density of players, the shape of the undulations or peaks to change the projectile nature of a struck ball, the symmetrical or asymmetrical nature to at one undulation or peak give a different projectile nature of a struck ball depending on the direction of travel and contact with the undulation or peak.

Further the elimination of dead spots allows the use of the stadium effect. This can include matters of crowd scene and accompanying crowd noise depending n the play of the game, it also can include score display in a stadium effect as well as advertising in a stadium effect. The advertising can extend around the vertical perimeter walls or be included in the score display in a manner that simulates real stadium advertising.

Whereas, the present invention has been described in relation to the drawings attached hereto, it should be understood that other and further modifications, apart from those shown or suggested herein, may be made within the spirit and scope of this invention as defined in the following claims.

The invention claimed is:

1. A method of providing advertising for a table top game with a real stadium game effect, the method comprising:

providing a table top ball game apparatus in a stadium effect by including a substantially horizontal playing surface, a substantially vertical boundary surface and surrounds that simulate a stadium structure or crowd scene;

providing a score means or advertising in the simulated stadium structure that simulates a scoreboard or advertising boards at a stadium;

relating the advertisement on the scoreboard or advertising boards with the start, progress or completion of a game on the table top ball game apparatus; and providing means for eliminating dead spots where a plurality of player figures cannot strike a ball on the playing surface, the means for eliminating includes a plurality of undulations that extend substantially across the horizontal playing surface and are spaced apart between the two goals, each of the plurality of undulations extending at least partially laterally to the longitudinal central axis of the playing surface for providing ball deflection that urges the ball to roll away from a respective undulation and across the substantially horizontal playing surface to remain within the range of the plurality of player figures mounted on a plurality of parallel user operated rods above the playing surface, the plurality of undulations forming at least a plurality of peaks that are located between each goal and a central area so that the ball is tended to zonal locations focused towards the plurality of player figures rather than merely to the goals or the center of the playing surface so as to more readily simulate a zonal field game play of a ball game, wherein the substantially vertical boundary surface includes an upper side surround formed by outwardly sloping sidewalls extending from an upper side of the substantially vertical boundary surface wherein the outwardly sloping walls assist to maintain the ball within the playing surface while allowing ready viewing of the playing surface and while providing a stadium appearance.

2. The method of claim 1 wherein:

the playing surface is substantially enclosed and includes a transparent dome structure simulating a stadium roof that allowing viewing of the playing surface and surrounds; and the means of eliminating dead spots further includes a plurality of deflectors.

3. The method of claim 1 wherein:

each undulation of the plurality of undulations is asymmetrical;

each undulation of the plurality of undulations comprises two shaped sides such that an effect on the ball hitting a respective undulation from either side is different and therefore the game play can be adjusted by the undulation near a particular goal to provide a first effect to the ball struck by a defending team that strikes one side of the undulation and a second effect to the ball struck by an attacking team that strikes the other side of the undulation, the first effect different from the second effect; and the two shaped sides provide different lift to the ball from the substantially horizontal playing surface on either side of a respective undulation as the ball moves across the substantially horizontal playing surface.

4. A table top ball game apparatus for allowing simulating of a field game play of a ball game between two teams, the apparatus comprising:

a substantially horizontal playing surface having a longitudinal central axis extending between two goals at opposite ends and through a central area of the playing surface;

an upright boundary surface circumferentially substantially surrounding the playing surface;

a plurality of parallel user operated rods mounted to extend through bores provided in each of the opposing upright boundary surfaces forming game apparatus sidewall wherein-the plurality of rods extend across the central axis over the central area of the playing surface, the plurality of rods control a plurality of player figures mounted thereon, the player figures populate above the playing surface, and provide striking elements of a ball on the substantially horizontal playing surface;

means for eliminating dead spots where the plurality of player figures cannot strike the ball on the playing surface, the means for eliminating includes a plurality of undulations that extend substantially across the horizontal playing surface and are spaced apart between the two goals, each of the plurality of undulations extending at least partially laterally to the longitudinal central axis for providing ball deflection that will urge the ball to roll away from a respective undulation and across the substantially horizontal playing surface to remain within the range of the plurality of player figures, the plurality of undulations forming at least a plurality of peaks that are located between each goal and the central area wherein a shape of each undulation of the plurality of undulations is a peaked undulation extending above a substantially flat playing surface so that the ball is tended to zonal locations focused towards the plurality of players rather than merely the goal or center so as to more readily simulate a zonal field game play of a ball game.

5. The table top ball game of claim 4 wherein the upright boundary surface includes a transparent upper dome section connected to the upper side surrounds to provide an enclosed means for maintaining the ball within an enclosed playing volume while the means for eliminating dead spots ensures continual means of play.

6. The table top ball game of claim 4 wherein a height of each undulation of the plurality of undulations above the playing surface is about half the ball height.

7. The table top ball game of claim 4 wherein a height of each undulation of the plurality of undulations above the playing surface is substantially in the range of 2 to 20 mm.

8. The table top ball game of claim 4 wherein each undulation of the plurality of undulations is symmetrical such that the effect of the ball hitting a respective undulation from either side is the same.

9. The table top ball game apparatus of claim 4 wherein the undulations extend substantially across an entire width of the playing area.

10. The table top ball game apparatus of claim 4 wherein a plurality of zonal locations extend across less than half an entire width of the playing area and on the central axis.

11. The table top ball game apparatus of claim 4 wherein the undulations compromise a height and a shape to provide a launch of the ball above the horizontal playing field.

12. The table top ball game apparatus of claim 4 further comprising substantially vertical side supports, and outwardly sloping sidewalls extending from an upper side of the upright boundary surface, and an outer skin surface extending from at least one of and underneath portion and an outer portion of the outwardly sloping sidewalls to extend substantially parallel to the substantially vertical side supports to provide spaced support of a handle end of each rod of the plurality of rods when mounted in bores of both the outer skin surface and the substantially vertical side supports; wherein a distal end of each rod of the plurality of rods is located in a protected volume that cannot be accessed by an opposing player on the opposing side of the first players user operated rods.

13. The table top ball game apparatus of claim 4 wherein:

the means for eliminating dead spots further comprises:

an upper outwardly sloping surface which extends from an upper side of the upright boundary surface; and a plurality of ball deflectors positioned between an adjacent pair of the plurality of undulations at a base of the upright boundary surface;

the plurality of undulations and ball deflectors each provide ball deflection that urges the ball to roll across the substantially horizontal playing surface towards a respective one of the plurality of player figures; and the upper outwardly sloping surface, the plurality of undulations, and ball deflectors cooperate to provide the means for eliminating dead spots so that the ball is urged, when inside the enclosed playing volume on the substantially horizontal playing surface and on the boundary surface to remain within the range of the plurality of player figures.

14. A table top ball game apparatus for allowing simulating of a field game play of a ball game between two teams, the apparatus comprising:

a substantially horizontal playing surface having a longitudinal central axis extending between two goals at opposite ends and through a central area of the playing surface;

an upright boundary surface circumferentially substantially surrounding the playing surface;

a plurality of parallel user operated rods mounted to extend through bores provided in each of the opposing upright boundary surfaces forming game apparatus sidewall wherein the plurality of rods extend across the central axis over the central area of the playing surface, the plurality of rods control a plurality of player figures mounted thereon, the player figures populate above the playing surface, and provide striking elements of a ball on the substantially horizontal playing surface;

means for eliminating dead spots where the plurality of player figures cannot strike the ball on the playing surface, the means for eliminating includes a plurality of undulations that extend substantially across the horizontal playing surface and are spaced apart between the two goals, each of the plurality of undulations extending at least partially laterally to the longitudinal central axis for providing ball deflection that will urge the ball to roll away from a respective undulation and across the substantially horizontal playing surface to remain within the range of the plurality of player figures, the plurality of undulations forming at least a plurality of peaks that are located between each goal and the central area so that the ball is tended to zonal locations focused towards the plurality of players rather than merely the goal or center so as to more readily simulate a zonal field game play of a ball game, wherein each undulation of the plurality of undulations is asymmetrical;

wherein each undulation of the plurality of undulations comprises two shaped sides such that an effect on the ball hitting a respective undulation from either side is different and therefore the game play can be adjusted by the undulation near a particular goal to provide a first effect to the ball struck by a defending team that strikes one side of the undulation and a second effect to the ball struck by an attacking team that strikes the other side of the undulation, the first effect different from the second effect; and wherein the two shaped sides provide different lift to the ball from the substantially horizontal playing surface on either side of a respective undulation as the ball moves across the substantially horizontal playing surface.

15. A table top ball game apparatus for allowing simulating of a field game play of a ball game between two teams, the apparatus comprising:

a substantially horizontal playing surface having a longitudinal central axis extending between two goals at opposite ends and through a central area of the playing surface;

an upright boundary surface circumferentially substantially surrounding the playing surface;

a plurality of parallel user operated rods mounted to extend through bores provided in each of the opposing upright boundary surfaces forming game apparatus sidewall wherein the plurality of rods extend across the central axis over the central area of the playing surface, the plurality of rods control a plurality of player figures mounted thereon, the player figures populate above the playing surface, and provide striking elements of a ball on the substantially horizontal playing surface;

means for eliminating dead spots where the plurality of player figures cannot strike the ball on the playing surface, the means for eliminating includes a plurality of undulations that extend substantially across the horizontal playing surface and are spaced apart between the two goals, each of the plurality of undulations extending at least partially laterally to the longitudinal central axis for providing ball deflection that will urge the ball to roll away from a respective undulation and across the substantially horizontal playing surface to remain within the range of the plurality of player figures, the plurality of undulations forming at least a plurality of peaks that are located between each goal and the central area so that the ball is tended to zonal locations focused towards the plurality of players rather than merely the goal or center so as to more readily simulate a zonal field game play of a ball game, wherein the spacing between the undulations of the plurality of undulations provides a differing game play effect by differing spacing and a shape and a height of an undulation relative to the distance from the goals wherein the differing spacing provides a section of the playing field sparser so as to simulate the real field game strategies more effectively.

* * * * *